United States Patent [19]

Geissler et al.

[11] Patent Number: 4,459,575

[45] Date of Patent: Jul. 10, 1984

[54] HIGH POWER TRANSFORMER

[75] Inventors: Klaus H. Geissler, Backnang; Herbert Bock, Oppenweiler, both of Fed. Rep. of Germany

[73] Assignee: LICENTIA Patent-Verwaltungs-GmbH, Frankfurt am Main, Fed. Rep. of Germany

[21] Appl. No.: 338,131

[22] Filed: Jan. 8, 1982

[30] Foreign Application Priority Data

Jan. 9, 1981 [DE] Fed. Rep. of Germany ..... 3100419

[51] Int. Cl.[3] ..... H01F 15/04

[52] U.S. Cl. ..... 336/84 R; 336/84 C; 336/90; 336/92; 336/96; 336/192; 336/196

[58] Field of Search ..... 336/84 C, 84 R, 90, 336/92, 96, 192, 196

[56] References Cited

U.S. PATENT DOCUMENTS

| | | | |
|---|---|---|---|
| 3,101,463 | 12/1958 | Penningroth | 336/87 |
| 3,138,771 | 6/1964 | Goldsmith et al. | 336/92 |
| 3,401,451 | 9/1968 | Slenker | 336/96 X |
| 3,551,864 | 12/1970 | Sweeney et al. | 336/96 X |
| 3,566,202 | 2/1971 | Carr | 336/84 C |
| 3,675,175 | 7/1972 | Dutton | 336/84 C |
| 4,176,334 | 11/1979 | Buritz et al. | 336/84 C |

FOREIGN PATENT DOCUMENTS

| | | | |
|---|---|---|---|
| 573879 | 4/1933 | Fed. Rep. of Germany . | |
| 1109268 | 7/1961 | Fed. Rep. of Germany . | |
| 976786 | 5/1964 | Fed. Rep. of Germany | 336/84 C |
| 1175297 | 8/1964 | Fed. Rep. of Germany . | |
| 1086363 | 6/1969 | Fed. Rep. of Germany . | |
| 7410923 | 3/1974 | Fed. Rep. of Germany . | |
| 1614522 | 10/1974 | Fed. Rep. of Germany . | |
| 2059861 | 9/1975 | Fed. Rep. of Germany . | |
| 2734169 | 3/1978 | Fed. Rep. of Germany . | |

*Primary Examiner*—J. V. Truhe
*Assistant Examiner*—Susan Steward
*Attorney, Agent, or Firm*—Spencer & Frank

[57] ABSTRACT

In a high power density transformer composed of a core and a coil assembly unit (or two such units), with the coil assembly unit including a primary winding, a secondary winding, a coil carrier supporting the windings, an insulating system, and a metal shield between the primary and secondary windings which is in electrically and thermally conductive connection with a metal grounding structure so that the metal grounding structure constitutes a support for the coil assembly, the metal shield serves as the coil carrier which is disposed directly on the metal grounding structure.

11 Claims, 4 Drawing Figures

FIG. 1
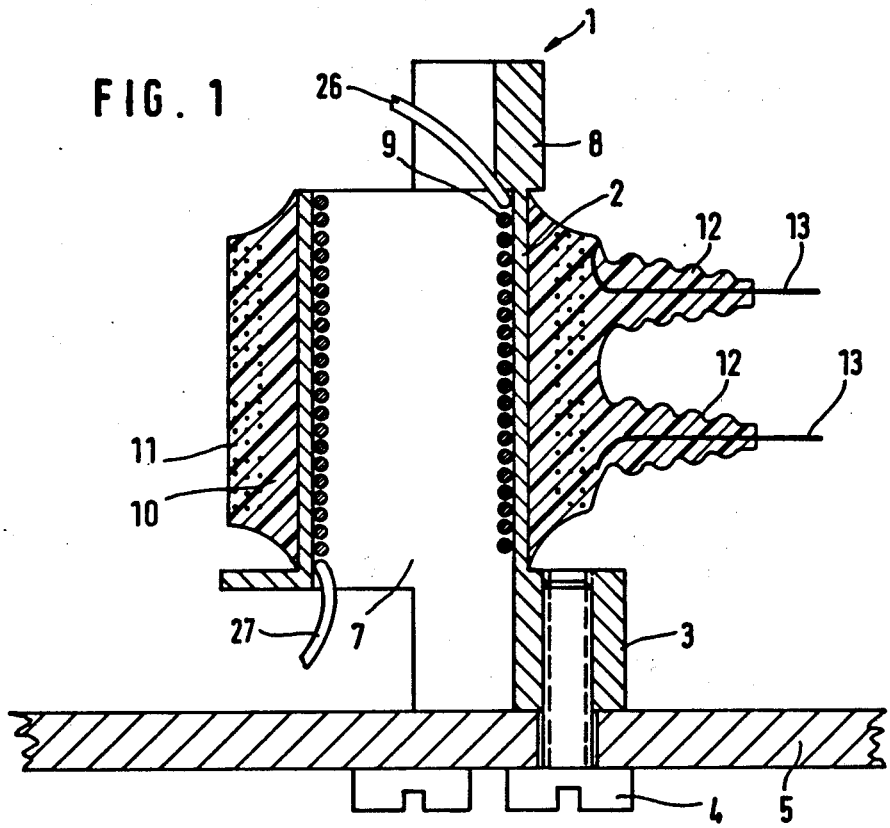
FIG. 1a
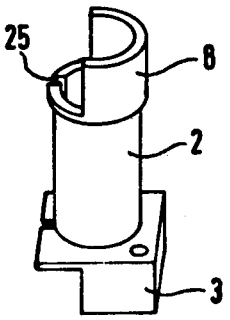
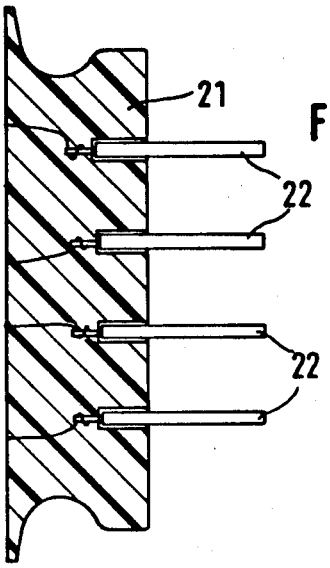
FIG. 2

HIGH POWER TRANSFORMER

BACKGROUND OF THE INVENTION

The present invention relates to a high power density transformer, particularly a high voltage transformer to be employed in a light weight switching regulator.

Known transformers of this type are currently used mainly in communications, aeronautics, and space applications. In the prior art transformers, the problems listed below have been solved - each one by itself - by means of more or less complicated measures:

(a) a ground connection with the lowest inductance possible of the electrostatic shielding between primary and secondary windings;

(b) cooling of the transformer components as efficiently as possible by heat conduction through metal; and (c) fastening of the transformer to a carrier (e.g. housing) in a mechanically most reliable manner - suitable for increased accelerations and stresses.

Each of the various known individual solutions to the above listed problems has a number of drawbacks. For example, the conventional shielding metals are difficult to control the with respect to geometric features; unavoidable corners and edges always give rise to the possibility of crack formation or corona effects when used in castings of high voltage transformers so that the reliability of the prior art transformers is fraught with problems.

SUMMARY OF THE INVENTION

It is an object of the present invention to provide a transformer with a low-inductance electrostatic shielding between primary and secondary, and sufficient cooling of the interior of the transformer by heat conduction through metal, as well as to provide a mechanically reliable fastening of the transformer on a grounding structure in the form of a metal carrier or an equipment housing.

The above and other objects are achieved, according to the present invention, in a high power density transformer unit including a primary winding, one or several secondary windings, a metal coil carrier supporting the windings, and insulating means between the primary and secondary windings, with the carrier constituting a metal shield between primary and secondary windings so that the metal carrier constitutes a support for the transformer unit.

The significant feature of the invention is that the above-mentioned problems are solved by a relatively simple metal component which serves at the same time as the electrostatic shield between primary and secondary windings, as a path for thermal conduction, and means for mechanical mounting of the coil assembly. Because the coil assembly is now a stand-alone device it is independent of other constituents of the transformer like the magnetic core and also of a possible second coil assembly on the same core. No immediate mechanical or thermal connection between the coil assemblies are required. This allows e.g. to operate core and coils at different temperatures as may be required for optimum efficiency and reliability.

BRIEF DESCRIPTION OF THE DRAWING

FIG. 1 is a cross-sectional view of a coil assembly of a transformer having a cylindrical sleeve, according to a preferred embodiment of the invention.

FIG. 1*a* is a perspective view of an essential multipurpose metal piece of the assembly of FIG. 1

FIG. 2 is a cross-sectional, detail view of the feed through area of the high voltage leads out of the coil assembly differing from that shown in FIG. 1.

DESCRIPTION OF THE PREFERRED EMBODIMENTS

Figure 3:
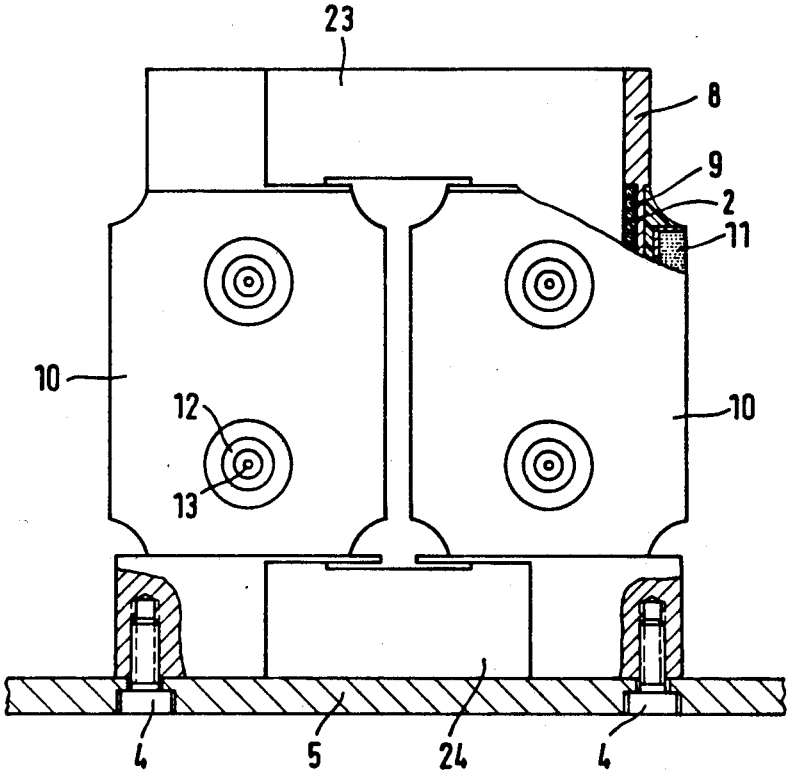
FIG. 3 is a partly broken-away view of a complete transformer having two coil assemblies shown in FIG. 1 provided with a transformer core (C-core with two halves).

The coil assembly shown in FIG. 1 has a one-piece metal component 1, shown explicitly in FIG. 1*a* which is essentially designed as a slotted cylindrical sleeve 2. At its lower end, the sleeve 2 carries projection 3 which forms part of component 1 and which facilitates the mounting of the assembly. The projection 3 is provided with a threaded bore which is not identified in detail. A threaded screw 4 engages in the threaded bore after passing through a bore, not identified in detail, in a wall 5 of the housing structure and thus assures that the sleeve 2 is mechanically firmly and directly connected with the wall 5 and is in electrically conductive connection therewith.

The cylindrical sleeve 2, whose interior 7 serves to accomodate the primary winding 9 and the transformer core, not illustrated here, is provided at its upper end with a cylindrical structural projection 8 also forming part of component 1. The outer diameter of the projection 8 is larger than the outer diameter of the sleeve 2. The projection 8 may have the shape of a partial cylinder, as shown in FIG. 1*a*. In the embodiment of FIG. 1 projection 8 serves for special structural purposes, e.g. for fastening further components to the structure. Naturally the transformer will be completely functional if projection 8 is left off altogether.

The transformer primary winding 9 is positioned in the interior 7 of the cylindrical sleeve 2 which constitutes a component of part 1 that acts as a metal shield. To avoid short circuits, sleeve 2 has a slot 25 shown in FIG. 1*a*. The sleeve 2 is enclosed by an insulating system 10 which is potted directly on the exterior wall of the sleeve 2 and in which is embedded the transformer secondary winding 11. The insulating system 10 carries also the feed throughs of the secondary coil 11, formed as frustoconical projections 12 as shown in FIG. 1. The connecting wires 26, 27 for the primary coil 9 as shown in FIG. 1 are brought to the outside through a lower and an upper opening provided in the sleeve 2. For special shielding purposes it is advantageous to lead the primary connecting wires immediately through the grounding structure 5.

FIG. 2 shows a rectangular prismatic projection 21 for secondary feed-throughs which can replace the frustoconical projections 12 shown in FIG. 1. The projection 21 which is potted to the insulating system 10 serves to accomodate four connecting wires 22 for the secondary winding 11, when the latter is a multiple winding provided with a plurality of taps.

FIG. 3 shows a complete transformer, having two coil assemblies as described above which are each seated on an arm of a two-part transformer C-core 23, 24. The other reference numerals of FIG. 3 correspond to those of FIGS. 1 and 1*a*.

It will be understood that the above description of the present invention is susceptible to various modifications, changes and adaptations, and the same are intended to be comprehended within the meaning and range of equivalents of the appended claims.

What is claimed is:

1. Coil assembly of a high power density transformer which is composed of a primary winding, a secondary winding, an insulating system, and a metal shield between said primary and secondary windings and in electrically conductive connection with a grounding structure so that the grounding structure constitutes a support for the coil assembly, wherein said metal shield comprises a cylindrical sleeve portion and a projection portion integral with, and projecting from one axial end of, said sleeve portion, said projection portion projecting radially outwardly from said sleeve and serving for fastening said shield directly to the grounding structure for establishing a low inductance thermal conduction path for efficiently conducting heat away from said windings, said primary winding is disposed in the interior of said sleeve portion, said insulating system encloses said sleeve portion, and said secondary winding is embedded in said insulating system 2. Coil assembly as defined in claim 1 wherein said sleeve portion is slotted longitudinally.

3. Coil assembly as defined in claim 1 wherein said insulating system comprises at least one projection for accomodating external connecting wires for said secondary winding.

4. Coil assembly as defined in claim 1 wherein said projection portion is oriented perpendicularly to the center axis of said sleeve portion.

5. Coil assembly as defined in claim 4 wherein said projection portion is in the general form of a prism extending radially from the center axis of said sleeve portion to beyond its outer periphery.

6. Coil assembly as defined in claim 5 wherein said projection portion is provided with a threaded bore which accommodates a threaded fastener which passes through a bore in the grounding structure.

7. Two coil assemblies each as defined in claim 1, 2 or 3 disposed next to one another.

8. An arrangement as defined in claim 7 wherein both of said assemblies are mounted on the two arms of a transformer C-core.

9. An arrangement as defined in claim 1 wherein said primary winding is located directly adjacent said sleeve portion.

10. A coil assembly of a high power density transformer in combination with a grounding structure, said coil assembly comprising a primary winding, a secondary winding, an insulating system, and a metal shield between said primary and secondary windings and in electrically conductive connection with said grounding structure so that said grounding structure constitutes a support for said coil assembly, wherein said metal shield comprises a cylindrical sleeve portion and a projection portion integral with, and projecting from one axial end of, said sleeve portion, said projection portion projecting radially outwardly from said sleeve and being directly fastened to said grounding structure for establishing a low inductance thermal conduction path for efficiently conducting heat away from said windings, said primary winding is disposed in the interior of said sleeve portion, said insulating system encloses said sleeve portion, and said secondary winding is embedded in said insulating system.

11. An arrangement as defined in claim 10 wherein said primary winding is located directly adjacent said sleeve portion.

* * * * *